US006523483B1

(12) United States Patent
Trent

(10) Patent No.: US 6,523,483 B1
(45) Date of Patent: Feb. 25, 2003

(54) CEMENT HOPPER CAR HATCH ANTI-ACCUMULATOR

(75) Inventor: Robert S. Trent, Crown Point, IN (US)

(73) Assignee: Holland Company, Crete, IL (US)

( * ) Notice: Subject to any disclaimer, the term of this patent is extended or adjusted under 35 U.S.C. 154(b) by 0 days.

(21) Appl. No.: 10/050,208

(22) Filed: Jan. 16, 2002

(51) Int. Cl.[7] ..... B61D 39/00
(52) U.S. Cl. ..... 105/377.07
(58) Field of Search ..... 105/377.05, 377.07, 105/377.08; 220/23.91, 200, 319, 320, 639, 640, 643, 648, 649, 718, 731; 114/201 R, 203

(56) References Cited

U.S. PATENT DOCUMENTS 2,116,418 A * 5/1938 Smithson ..... 220/718
3,155,987 A * 11/1964 McGrill ..... 2/322
4,352,438 A * 10/1982 Carino ..... 220/718
4,864,698 A * 9/1989 Brame ..... 128/DIG. 15
5,011,038 A * 4/1991 Schultz ..... 220/319
5,102,265 A * 4/1992 Dokmo et al. ..... 405/195.1

* cited by examiner

*Primary Examiner*—Mark T. Le
(74) *Attorney, Agent, or Firm*—David C. Brezina; Barnes & Thornburg

(57) ABSTRACT

A hatch anti-accumulator constructed from a suitable plastic material formed into a rectangular sheet. Slots designed to accommodate fasteners are provided near each end of the material. The rectangular sheet is then bent or rolled to form a short cylinder or ring conforming to the shape of a loading hatch and/or nozzle, and forming a bib or sleeve around the exterior of the hatch and/or nozzle. The bib is then secured in position by installing fasteners through the slots provided. The anti-accumulator fits around the loading nozzle (or hatch coaming) on the top of cement hopper cars to allow accumulated cured particulate matter to be easily released from the nozzle.

10 Claims, 4 Drawing Sheets

CEMENT HOPPER CAR HATCH ANTI-ACCUMULATOR

FIELD OF THE INVENTION

This invention relates generally to rail hopper cars and in particular to rail hopper cars having hatches prone to fouling, and is more particularly directed toward an accessory that forestalls fouling of cement hopper car hatch nozzles caused by accretion and hardening of particulate matter, such as cement dust.

BACKGROUND OF THE INVENTION

Hatch gaskets of various material and configuration are believed to be the closest art, however these are all designed for sealing the hatch against the hatch housing, which is not the primary purpose of the instant anti-accumulator. In the field, the problem solved by the instant anti-accumulator has been effectively uncontrolled. Cement powder builds surrounding the hatch housing or nozzle that is used to fill the hopper car.

Humidity, precipitation, condensation, insufficient cleaning or the like, which occurs at some later time, begins the chemical reaction by which the cement cures. As more powder or dust builds, and more curing occurs, a mass of solid, cured cement is formed which eventually has a number of unwanted characteristics. These include physical interference with nozzle and hatch operation, added mass, and general wear on the rail car.

In the prior art, such a build-up of cured cement is manually removed with a variety of tools, such as hammers, chisels and various cutting tools. Neither use of accessories for protection, nor surface treatment such as by lubricants, is practiced in the prior art. Consequently, a need arises for a reliable and economical accessory that prevents objectionable build-up of particulate matter leading to fouling.

SUMMARY OF THE INVENTION

These needs and others are satisfied by the cement hopper car hatch anti-accumulator of the present invention. The hatch anti-accumulator is preferably formed from a flexible PVC (polyvinyl chloride) material, rated at about a Shore A durometer of 90, and molded with a UV (ultraviolet) inhibitor. Of course, the durometer of the material may vary considerably while still allowing the material to perform its intended function. The material should simply be stiff enough to remain in position. In the alternative, the hatch anti-accumulator of the invention may be constructed from a PE (polyethylene) foam having a density of about 4 pounds, and provided with a relatively thin Surlyn film, including a UV inhibitor, on its outer surface.

Using either of the preferred materials, the PVC or PE foam is formed into a rectangular sheet approximately 97.5 inches long and about 3.75 inches wide. A pair of slots designed to accommodate fasteners are provided near each end of the material. The rectangular sheet is then bent or rolled to form a short cylinder or ring conforming to the shape of a loading hatch and/or nozzle, and forming a bib or sleeve around the exterior of the hatch and/or nozzle. The bib is then secured in position by installing fasteners through the slots provided. The anti-accumulator fits around the loading nozzle (or hatch coaming) on the top of cement hopper cars to allow accumulated cured Portland cement to be easily released from the nozzle. Currently (without such a product), the cement adheres stubbornly to the steel nozzles and car roof. The part can also work together with a roof spill guard. The material selected allows the cured cement to release easily. While the anti-accumulator of the present invention is specifically designed to use PVC or PE foam to permit easy removal of Portland cement, other similar materials could be used, and other analogous uses could be fulfilled by the invention.

In accordance with one aspect of the present invention, a hatch bib assembly adapted for installation around the hatch coaming exterior of a railroad hopper car comprises a substantilly rectangular sheet of plastic material having a first end and a second end, including at least a pair of elongated openings therethrough, one proximate the first end and the other proximate the second end, and at least one fastener adapted for insertion through the pair of elongated openings. A plastic cylinder is formed around the hatch coaming by wrapping the rectangular sheet around the hatch coaming exterior, overlapping the first end and the second end, aligning the elongated openings, and inserting the fastener therethrough, thereby forestalling accretion and hardening of particulate matter on the hopper car hatch exterior.

In one form of the invention, the substantially rectangular sheet of plastic material may be formed from PVC. In an alternative embodiment, the substantially rectangular sheet of plastic material may be formed from polyethylene foam. The polyethylene foam may further includes a relatively thin layer of protective film on its exterior surface. In accordance with yet another form of the invention, the substantially rectangular plastic sheet may include a pair of elongated openings proximate the first end, and a pair of elongated openings proximate the second end.

In accordance with another aspect of the present invention, a method for preventing accumulation of particulate matter on the exterior of a rail hopper car hatch having a hatch coaming comprising the steps of providing a substantially rectangular sheet of plastic material having a first end and a second end, including at least a pair of elongated openings therethrough, one proximate the first end and the other proximate the second end, providing at least one fastener adapted for insertion through the pair of elongated openings, and forming a plastic cylinder around the hatch coaming by wrapping the rectangular sheet around the hatch coaming exterior, overlapping the first end and the second end, aligning the elongated openings, and inserting the fastener therethrough. This forestalls accretion and hardening of particulate matter on the hopper car hatch exterior.

In one form of the invention, the step of providing a substantially rectangular sheet of plastic material further comprises the step of providing a substantially rectangular sheet of plastic material formed from PVC. In an alternative embodiment of the invention, the step of providing a substantially rectangular sheet of plastic material further comprises the step of providing a substantially rectangular sheet of plastic material formed from polyethylene foam. The polyethylene foam may further include a relatively thin layer of protective film on its exterior surface. In yet another form of the invention, the step of providing a substantially rectangular sheet of plastic material may further comprise the step of providing a substantially rectangular sheet of plastic material including a pair of elongated openings proximate the first end, and a pair of elongated openings proximate the second end.

Further objects, features, and advantages of the present invention will become apparent from the following description and drawings.

DETAILED DESCRIPTION OF THE INVENTION

There is described herein a cement hopper car hatch anti-accumulator that offers distinct advantages when compared to the prior art.

Figure 1:
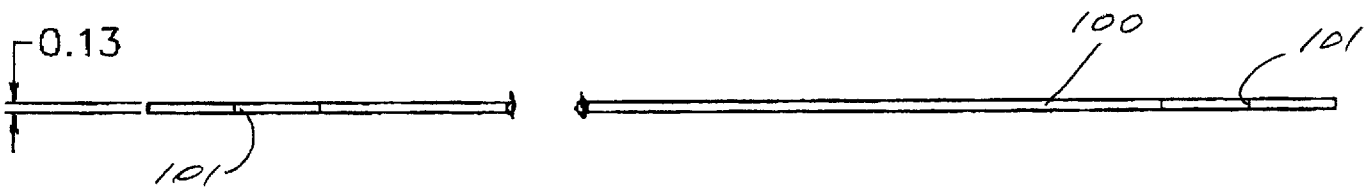
FIG. 1 is a side elevational view of a substantially rectangular sheet of plastic material.
Figure 2:
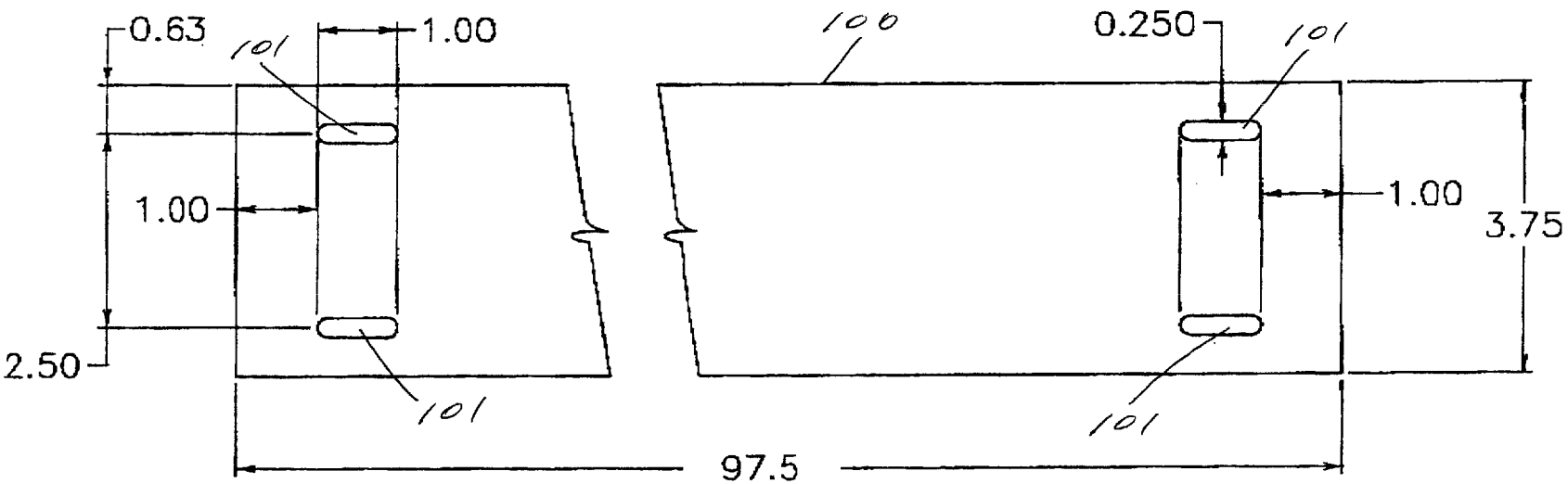
FIG. 2 is a top plan view of the sheet of FIG. 1.

FIGS. 1 and 2 depict a substantially rectangular plastic sheet from which the antiaccumulator or hatch bib of the present invention is preferably constructed. The sheet 100 of FIGS. 1 and 2 is formed from PVC, or polyvinyl chloride, having a thickness of about 0.13 inch, a length of approximately 97.5 inches, and a width of about 3.75 inches. Of course, different width and length dimensions may be used depending upon nozzle diameter and height. Preferably, the PVC material has a Shore A durometer of about 90, although specific durometer does not affect the part's function so long as it is rigid enough to remain in place after installation.

A plurality of elongated holes or slots 101 are provided near the respective ends of the sheet 100. Preferably, each of these slots 101 measures about 1.00 inch long and approximately 0.250 inch wide. The slots 101 are disposed on the sheet 100 so that the sheet 101 can be bent or rolled into a relatively short cylinder or ring, and when one end of the sheet 100 overlies a portion of the other end of the sheet, the slots 101 will then line up with each other and fasteners can be inserted through the slots 101. This formation of the sheet 100 into a cylinder or ring shape will be described in more detail below.

Figure 3:
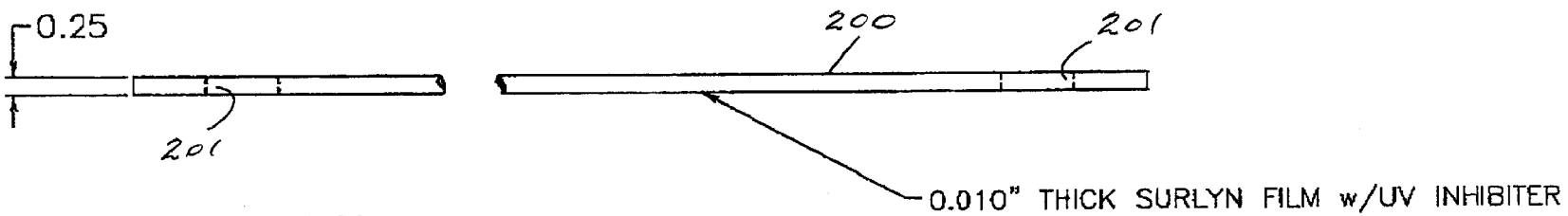
FIG. 3 is a side elevational view of an alternative plastic sheet.
Figure 4:
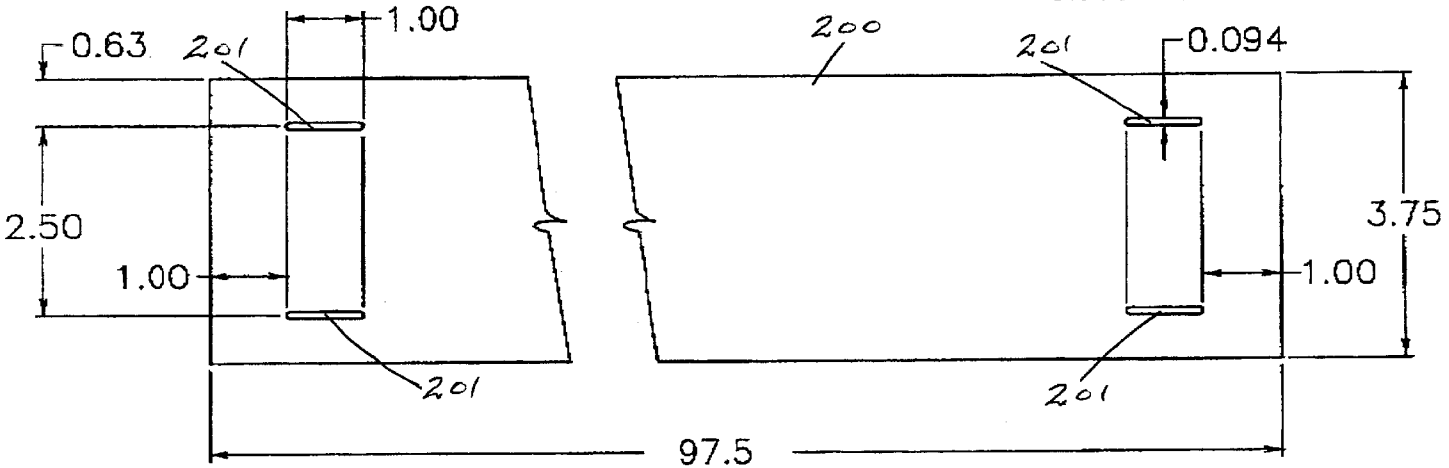
FIG. 4 is a top plan view of the sheet of FIG. 3.

Alternatively, as shown in FIGS. 3 and 4, a suitable plastic sheet 200 can be formed from polyethylene (PE) foam of about 3 to 4 pounds density. Preferably, the PE sheet 200 includes a film of Surlyn to a thickness of about 0.010 inch, and includes an ultraviolet (UV) inhibitor. The film applied to the plastic sheet 200 need only be applied to one surface; that is, the surface that becomes the outer surface upon installation. The thin film coating increases structural integrity, aids in removal of particulate material, and provides a measure of weather resistance for the installed anti-accumulator, as will be described in more detail subsequently. The rectangular plastic sheets illustrated in FIGS. 1 through 4 may be cut or sheared from larger stock sheets.

Figure 5:
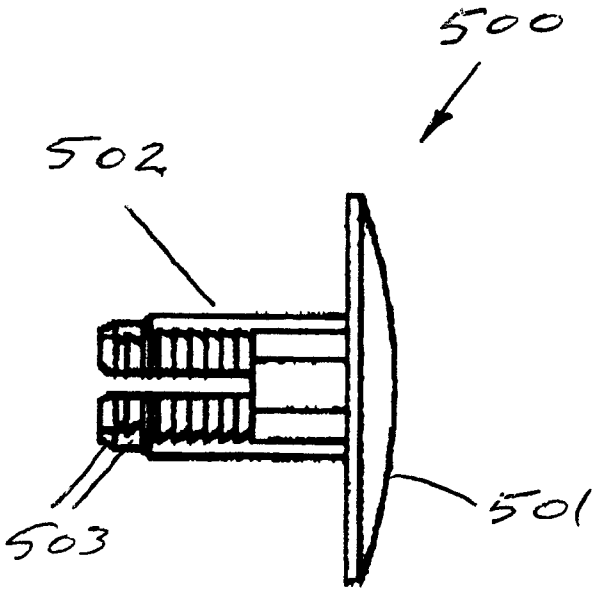
FIG. 5 is a side elevational view of a ratcheting action rivet.
Figure 6:
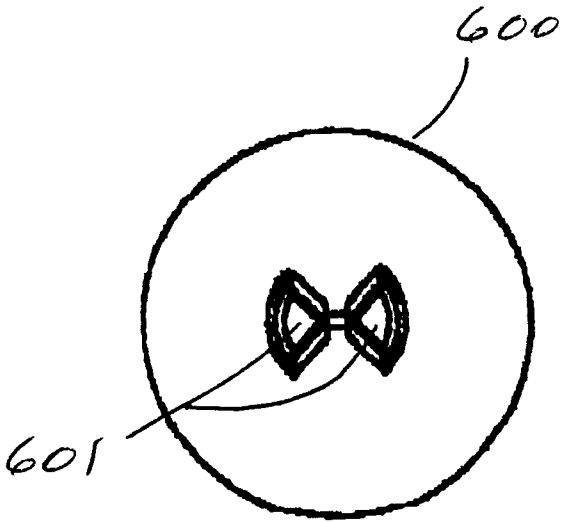
FIG. 6 is a plan view of a mating rivet for the rivet of FIG. 5.

FIGS. 5 and 6 depict a fastener suitable for securing the anti-accumulator in position. Of course, other types of fasteners may also be suitable, but the fastener illustrated has been shown to be particularly effective. FIG. 5 shows the rivet portion of the fastener, generally depicted by the numeral 500. The rivet 500 has a relatively large circular head portion 501 that is about 0.75 inch in diameter, and an elongated shank 502 (about 0.344 inch long) with a plurality of gripper teeth 503 molded therein.

The rivet 500 is designed to engage with mating rivet 600 (FIG. 6). A pair of openings 601 formed in the rivet 600 interlocks with the gripper teeth 503 of FIG. 5 to provide a secure bond. Both the rivet 500 and mating rivet 600 are molded from Type 6/6 Nylon and are available from Micro Plastics, Inc. of Flippin, Ark. as Part No. 27QB700375N.

Figure 7:
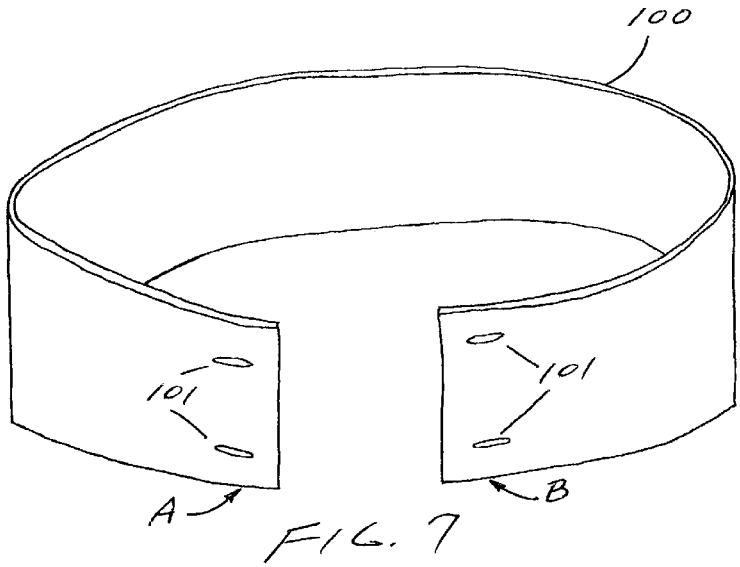
FIG. 7 is a perspective view of a hatch bib in accordance with the present invention.

FIG. 7 illustrates the manner in which the rectangular sheet of plastic (FIGS. 1–4) is bent or folded into the cylinder or ring described above. The PVC rectangular sheet 100 of FIGS. 1 and 2 is shown for illustrative purposes, but the same configuration can be achieved with the sheet 200 of FIGS. 3 and 4. Once the sheet 100 is bent or rolled into its cylindrical shape, regions A and B, near the respective ends of the sheet 100, are simply overlapped so that the slots 101 in region B directly overlay the slots 101 in region A. With the slots 101 properly aligned, it is then a simple matter to insert rivets 500 to fasten the cylindrical hatch bib, or anti-accumulator, in position, as illustrated in FIG. 8.

A hatch anti-accumulator 100 is mounted on a hatch of a railcar specifically surrounding and overlapping the hatch coaming 400. The hatch is affixed to the upper surface 402 of a rail hopper car 401, which is shown cut away for simplicity of illustration. Region C represents the area of overlap of end portions A and B shown in FIG. 7. As illustrated, the anti-accumulator 100 is fastened in position by rivets 500 inserted through the properly aligned slots 101 of both end regions A, B. Mating rivets 600 (not shown in FIG. 8) are then affixed to the rivets 500 to complete the installation.

Figure 8:
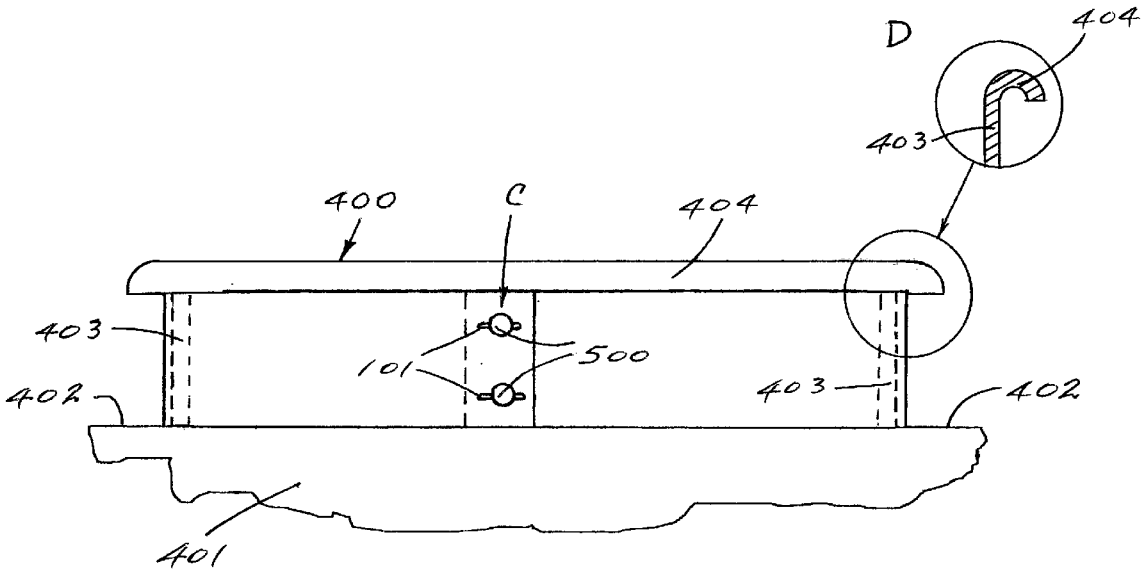
FIG. 8 is a side elevational view of a hatch bib in accordance with the present invention installed around a hatch coaming.

The lip 404 provided around a typical hatch is also illustrated in FIG. 8. Inset D (a section view of the circled area of FIG. 8) shows that the hatch sidewalls 403 are simply bent outward all around the hatch opening to form the lip 404.

It should be noted that the anti-accumulator 100 may work in cooperation with plastic sheets (or other types of barriers) installed on the upper surface 402 adjacent the hatch coaming 400. In this way, hardened particulate material can be removed both from the hatch itself and from the area of the upper surface 402 near the hatch coaming 400.

There has been described herein a cement hopper car hatch anti-accumulator that offers distinct advantages when compared with the prior art. It will be apparent to those skilled in the art that modifications may be made without departing from the spirit and scope of the invention. Accordingly, it is not intended that the invention be limited except as may be necessary in view of the appended claims.

What is claimed is:

1. A hatch bib assembly adapted for installation around the hatch coaming exterior of a railroad hopper car, the hatch bib assembly comprising:

a substantially rectangular sheet of plastic material having a first end and a second end, including at least a pair of elongated openings therethrough, one proximate said first end and the other proximate said second end; and at least one fastener adapted for insertion through said pair of elongated openings;

such that a plastic cylinder is formed around the hatch coaming by wrapping the rectangular sheet around the hatch coaming exterior, overlapping said first end and said second end, aligning said elongated openings, and inserting said fastener therethrough, thereby forestalling accretion and hardening of particulate matter on the hopper car hatch exterior.

2. The hatch bib assembly of claim 1, wherein the substantially rectangular sheet of plastic material is formed from PVC.

3. The hatch bib assembly of claim 1, wherein the substantially rectangular sheet of plastic material is formed from polyethylene foam.

4. The hatch bib assembly of claim 3, wherein the polyethylene foam further includes a relatively thin layer of protective film on its exterior surface.

5. The hatch bib assembly of claim 1, wherein the substantially rectangular plastic sheet includes a pair of elongated openings proximate said first end, and a pair of elongated openings proximate said second end.

6. A method for preventing accumulation of particulate matter on the exterior of a rail hopper car hatch having a hatch coaming, the method comprising the steps of:

(a) providing a substantially rectangular sheet of plastic material having a first end and a second end, including at least a pair of elongated openings therethrough, one proximate said first end and the other proximate said second end;

(b) providing at least one fastener adapted for insertion through said pair of elongated openings; and (c) forming a plastic cylinder around the hatch coaming by wrapping the rectangular sheet around the hatch coaming exterior, overlapping said first end and said second end, aligning said elongated openings, and inserting said fastener therethrough;

thereby forestalling accretion and hardening of particulate matter on the hopper car hatch exterior.

7. The method in accordance with claim 6, wherein the step (a) of providing a substantially rectangular sheet of plastic material further comprises the step of providing a substantially rectangular sheet of plastic material formed from PVC.

8. The method in accordance with claim 6, wherein the step (a) of providing a substantially rectangular sheet of plastic material further comprises the step of providing a substantially rectangular sheet of plastic material formed from polyethylene foam.

9. The method in accordance with claim 8, wherein the polyethylene foam further includes a relatively thin layer of protective film on its exterior surface.

10. The method in accordance with claim 6, wherein the step (a) of providing a substantially rectangular sheet of plastic material further comprises the step of providing a substantially rectangular sheet of plastic material including a pair of elongated openings proximate said first end, and a pair of elongated openings proximate said second end.

* * * * *